US007210578B2

(12) United States Patent
Tuan-Mu et al.

(10) Patent No.: US 7,210,578 B2
(45) Date of Patent: May 1, 2007

(54) DISPLAY UNIT FOR STORING TOOL ASSEMBLY

(75) Inventors: Hsien-Chung Tuan-Mu, Taichung (TW); Sammy Tsai, Taichung (TW)

(73) Assignee: Lea Way Hand Tool Corporation, Taichung (TW)

( * ) Notice: Subject to any disclaimer, the term of this patent is extended or adjusted under 35 U.S.C. 154(b) by 0 days.

(21) Appl. No.: 11/167,331

(22) Filed: Jun. 27, 2005

(65) Prior Publication Data

US 2006/0070902 A1 Apr. 6, 2006

(30) Foreign Application Priority Data

Oct. 6, 2004 (TW) ..... 93130251 A

(51) Int. Cl.
*B65D 85/28* (2006.01)

(52) U.S. Cl. ..... 206/378; 206/759

(58) Field of Classification Search ..... 206/372–379, 206/759, 764, 765; 211/70.6
See application file for complete search history.

(56) References Cited

U.S. PATENT DOCUMENTS 5,711,428 A * 1/1998 Ho ..... 206/738
6,398,027 B1 * 6/2002 Ryu ..... 206/372
6,942,095 B2 * 9/2005 Chen ..... 206/376
6,988,616 B2 * 1/2006 Chen ..... 206/379
2004/0084341 A1 * 5/2004 Amtenbrink ..... 206/372
2004/0188279 A1 * 9/2004 Chen ..... 206/372
2005/0056559 A1 * 3/2005 Chen ..... 206/372

* cited by examiner

*Primary Examiner*—Luan K. Bui
(74) *Attorney, Agent, or Firm*—Ladas and Parry LLP

(57) ABSTRACT

A display unit for storing a tool assembly, comprising a base, a moving-rotating mechanism and a support plate. The base has a front end, a rear end opposite the front end and two opposite sides. The moving-rotating mechanism comprises at least one moving-rotating device. The support plate has a front end and two opposite sides for supporting the tool assembly. At least one of the two opposite sides of the base is coupled to at least one of the two opposite sides of the support plate by at least one moving-rotating device, and the front end of the support plate is moveable and rotatable from a first position at the front end of the base to a second position at the rear end of the base.

14 Claims, 10 Drawing Sheets

DISPLAY UNIT FOR STORING TOOL ASSEMBLY

BACKGROUND OF THE INVENTION

1. Field of the Invention

The present invention relates to a display unit for storing a tool assembly, especially a support for a tool assembly (such as sleeves), where the support is moveable and rotatable with respect to a base (not about a fixed axis of rotation) such that the tool assembly can be easily retrieved to use and stored in the display unit safely and securely. The present application claims priority from ROC (Taiwan) Patent Application No. 093130251.

2. Description of the Related Art

FIG. 1 shows a conventional display unit 100 for tool assembly. The display unit 100 comprises a base 101 with a plurality of slots 102 formed thereon for accommodating a plurality of tool assembly parts such as sleeves 103. A fence 104 is disposed at the front end of the base 101 to prevent the sleeves 103 from falling or sliding out of the base 101. A lid 105 is disposed at the top rear edge of the base 101 and two latches 106 are disposed at the front end of the lid 105. A slot 107 is formed in each of the latches 106 to engage the corresponding protrusion 108 disposed at the front end of the base 101 such that the sleeves 103 are received in the slots 102. A slot 110 is formed at opposite sides of the lid 105 to engage a corresponding protrusion 109 disposed at the top opposite sides of the base 101. When retrieving sleeves 103, a user has to manually disengage the two latches 106 with the protrusions 108 and the slots 110 with the protrusions 109, respectively, to open the lid 105 first. With this configuration, if sleeves 103 are received in the slots 102 too loosely, the sleeves 103 may be likely to fall or slide out from the display unit 100 in the user's hand when shaking. If the sleeves 103 are received in the slots 102 too tightly, although the sleeves 103 can be secured to the base 101 effectively, it may not be easy to retrieve the sleeves 103 when in a rush as they may be stuck in the slots 102. In addition, as the lid 105 engages the base 101 by way of latching, it is likely to break the latches 106 or protrusions 108, 109 when closing the lid 105, which render the lid 105 unable to secure the sleeves 103 and therefore makes the display unit 100 useless.

FIG. 2 shows the other conventional display unit 200 for tool assembly comprising a base 201. A shaft 202 spaced from and parallel to an inner surface of the base 201 is disposed in the base 201 for accommodating securing means 203. Rotation means is disposed in the shaft 202 such that the securing means 203 can be rotated to a certain angle respect to the base 201 and shaft 202. A fence 205 is disposed at one end of the base 201 for preventing sleeves 204 from falling or sliding out of the base 201 or inappropriate retrieval. A rod 206 is disposed between the securing means and the base 201 for preventing the securing means 203 from rotating when the sleeves 204 are in place and therefore ensuring a secured package. When the sleeves 204 are being retrieved, one end of the rod 206 has to be cut and removed first and the sleeves 204 are then rotated and retrieved. However, such configuration is considered complicated, inconvenient and spacey.

From the above, it is necessary for the industry to provide a display unit which is easier to use, less spacey and can overcome the defects mentioned in the prior art.

SUMMARY OF THE INVENTION

It is an object of the present invention to provide a display unit which is easier to use and less spacey.

According to the present invention, a display unit for storing a tool assembly comprises a base, a moving-rotating mechanism and a support plate. The base has a front end, a rear end opposite the front end and two opposite sides. The moving-rotating mechanism comprises at least one moving-rotating device. The support plate has a front end and two opposite sides for supporting the tool assembly. At least one of the two opposite sides of the base is coupled to at least one of the two opposite sides of the support plate by at least one moving-rotating device. And the front end of the support plate is moveable and rotatable from a first position at the front end of the base to a second position at the rear end of the base.

Other objects, advantages and novel features of the present invention will be drawn from the following detailed description of preferred embodiments of the present invention with the accompanying drawings, in which:

DESCRIPTIONS OF THE DRAWINGS

DETAILED DESCRIPTION OF THE INVENTION

Figure 1:
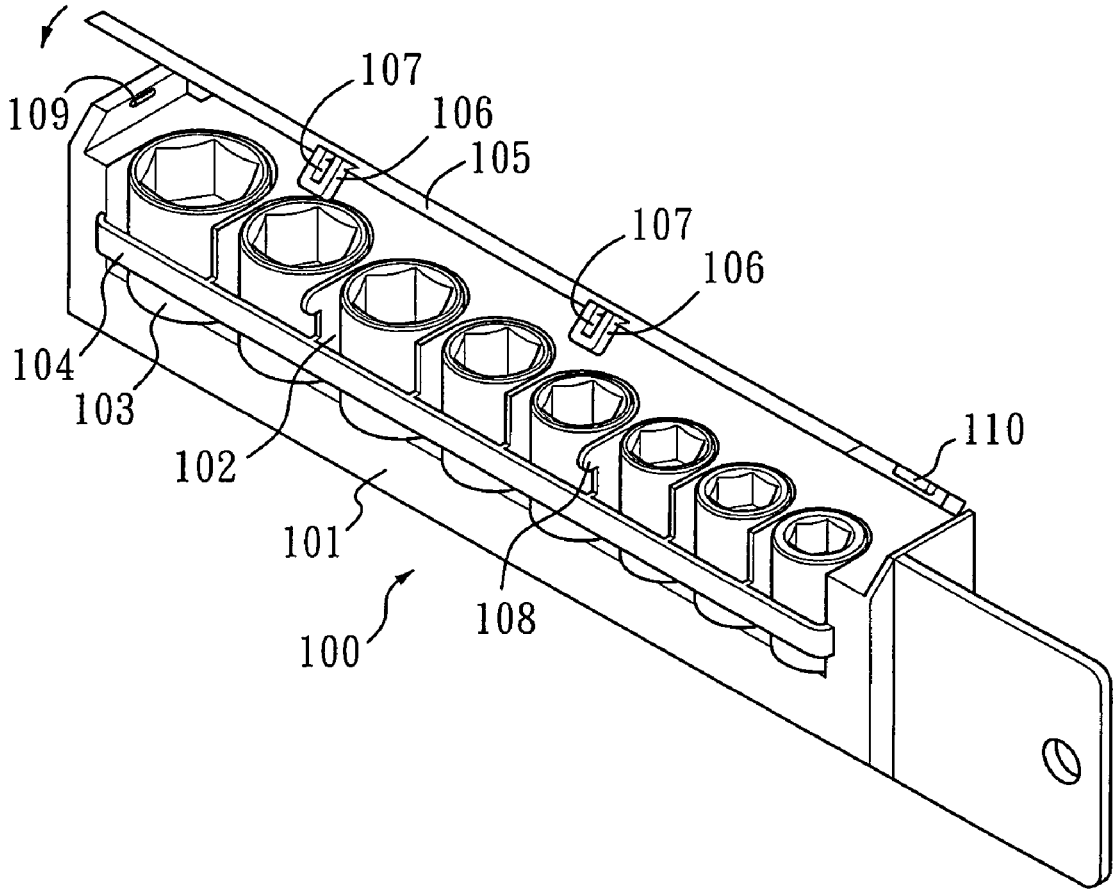
FIG. 1 (PRIOR ART)
FIG. 1 illustrates a schematic view of a conventional tool display unit.
Figure 2:
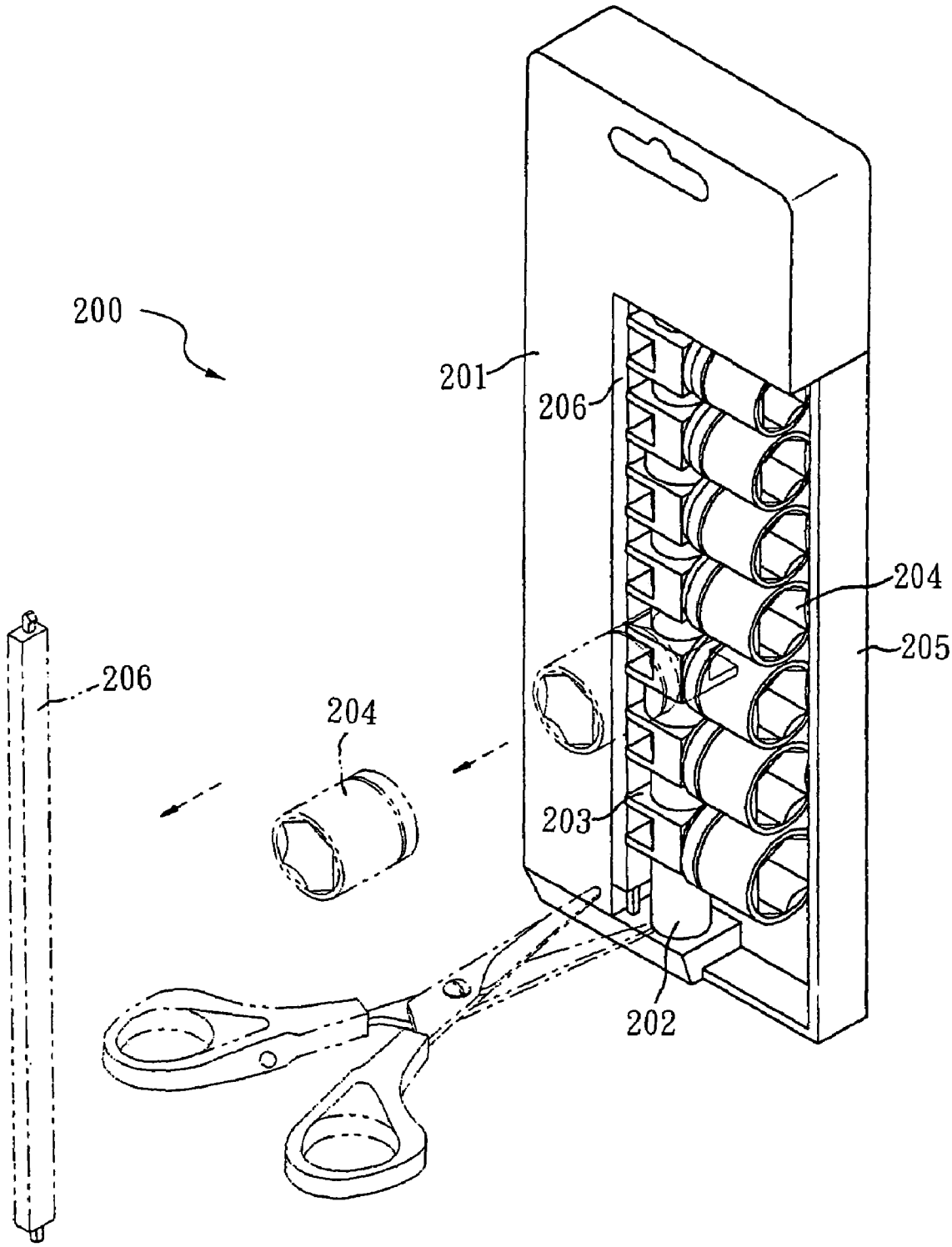
FIG.2 (PRIOR ART)
FIG. 2 illustrates a schematic view of the other conventional tool display unit.
Figure 3:
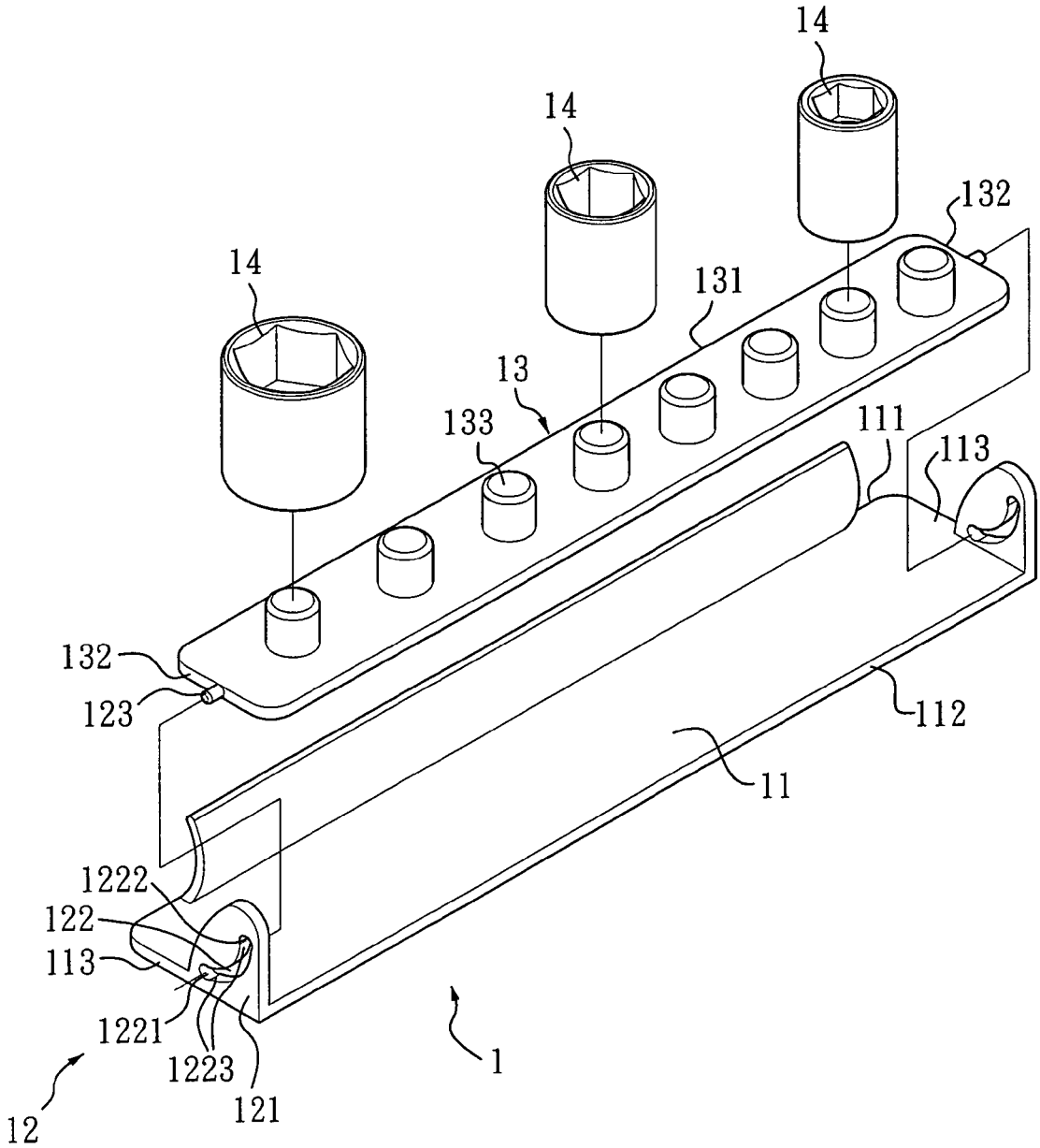
FIG. 3 illustrates an exploded view of a tool display unit according to the present invention.
Figure 4:
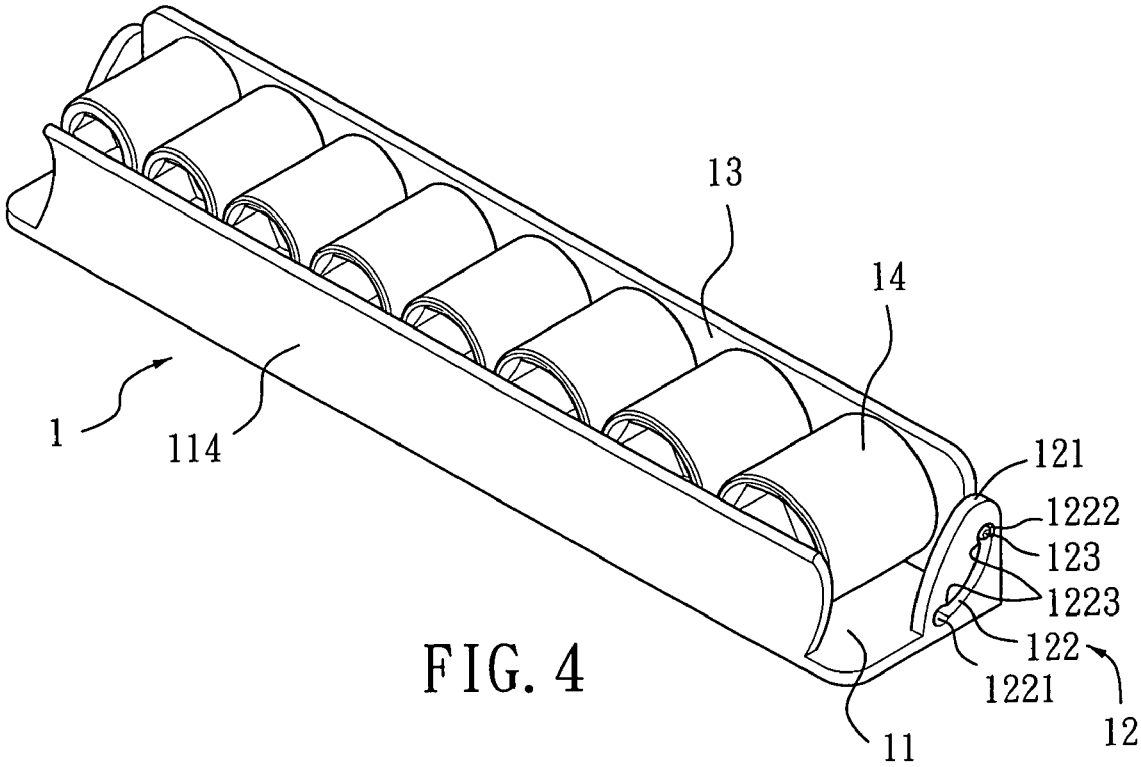
FIG. 4 illustrates a schematic view showing sleeves rotated to a secured position.
Figure 5:
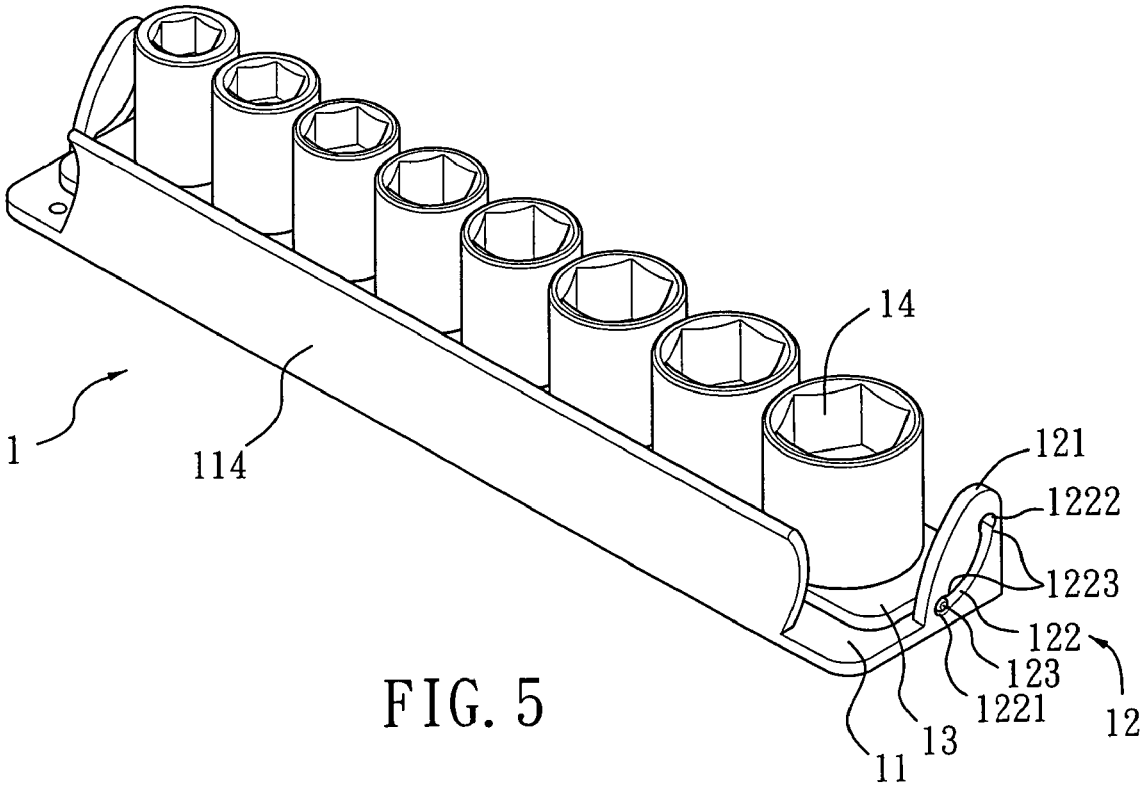
FIG. 5 illustrates a schematic view showing the sleeves rotated upwards to a retrievable position and ready for retrieval.
Figure 6A:
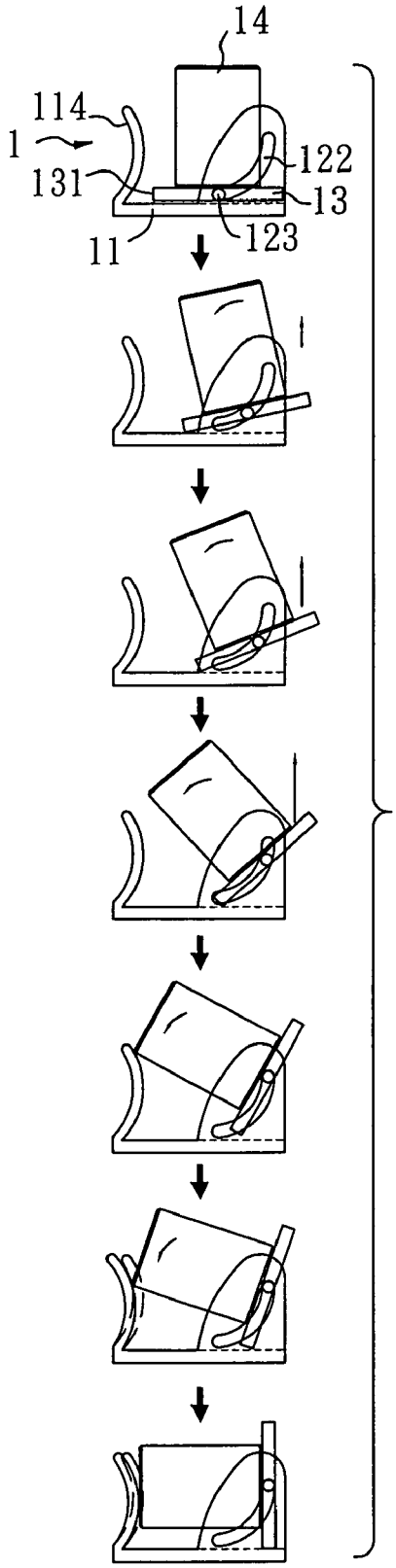
FIGS. 6A and 6B illustrate the tool display unit of FIGS. 3 to 5 switched between the secured position and the retrievable position.

FIGS. 3 to 5 illustrate exploded and schematic views of a display unit for storing a tool assembly according to the present invention. The display unit 1 for storing a tool assembly comprises a base 11, a moving-rotating mechanism and a support plate 13. The base 11 has a front end 111, a rear end 112 opposite the front end 111 and two opposite sides 113. The moving-rotating mechanism comprises at least one moving-rotating device 12. The support plate 13 has a front end 131 and two opposite sides 132 for supporting the tool assembly, such as sleeves 14. At least one of the two opposite sides 113 of the base 11 is coupled to at least one of the two opposite sides 132 of the support plate 13 by at least one moving-rotating device 12. As shown in the figures, preferably each of the two opposite sides 113 of the base 11 is coupled to the corresponding one of the two opposite sides 132 of the support plate 13 by the respective moving-rotating device 12 such that the front end 131 of the support plate 13 is moveable and rotatable from a first position at the front end 111 of the base 11 (referring to FIG. 5 and the topmost view of FIG. 6A) to a second position at the rear end 112 of the base 11 (referring to FIG. 4 and the bottommost view of FIG. 6A).

Now referring to FIG. 3, each of the moving-rotating devices 12 comprises a wing 121, a guiding slot 122 and a protrusion 123. The wing 121 is disposed perpendicularly at each of the two opposite sides 113 of the base 11 while the guiding slot 122 is formed in the wing 121. The protrusion 123 is disposed transversely at each of the two opposite sides 132 of the support plate 13. When each of the two opposite sides 113 of the base 11 is coupled to the corresponding one of the two opposite sides 132 of the support plate 13, each protrusion 123 is then moveable and rotatable along the guiding slot 122 of the wing 121. The guiding slot can be an arc curvedly extending upwards and backwards (referring to FIGS. 3 to 5), or can be a straight line shape extending backwards (referring to reference numeral 122' in FIG. 7). The guiding slot 122 comprises a front section 1221 and a rear section 1222 and each section has a narrowing neck 1223 formed thereof. When the protrusion 123 passes through the neck 1223, the protrusion 123 is provided with a proper friction force such that the protrusion 123 of the support plate 13 can be properly positioned at the front section 1221 or the rear section 1222.

Figure 6B:
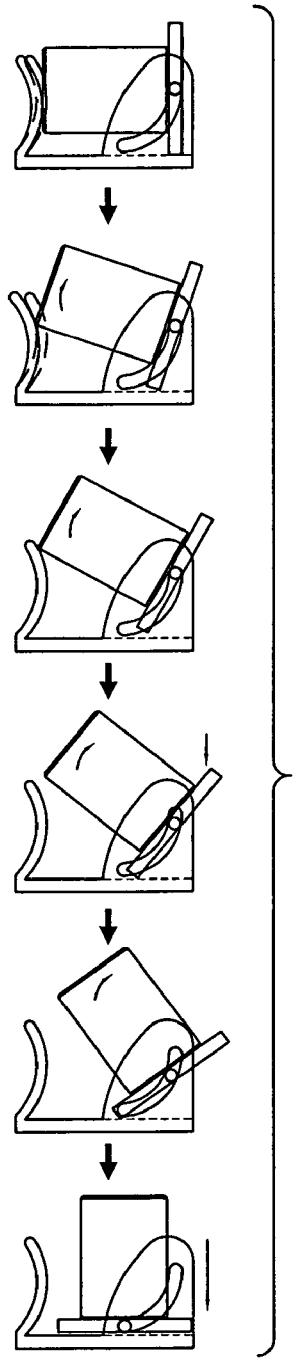
Figure 7:
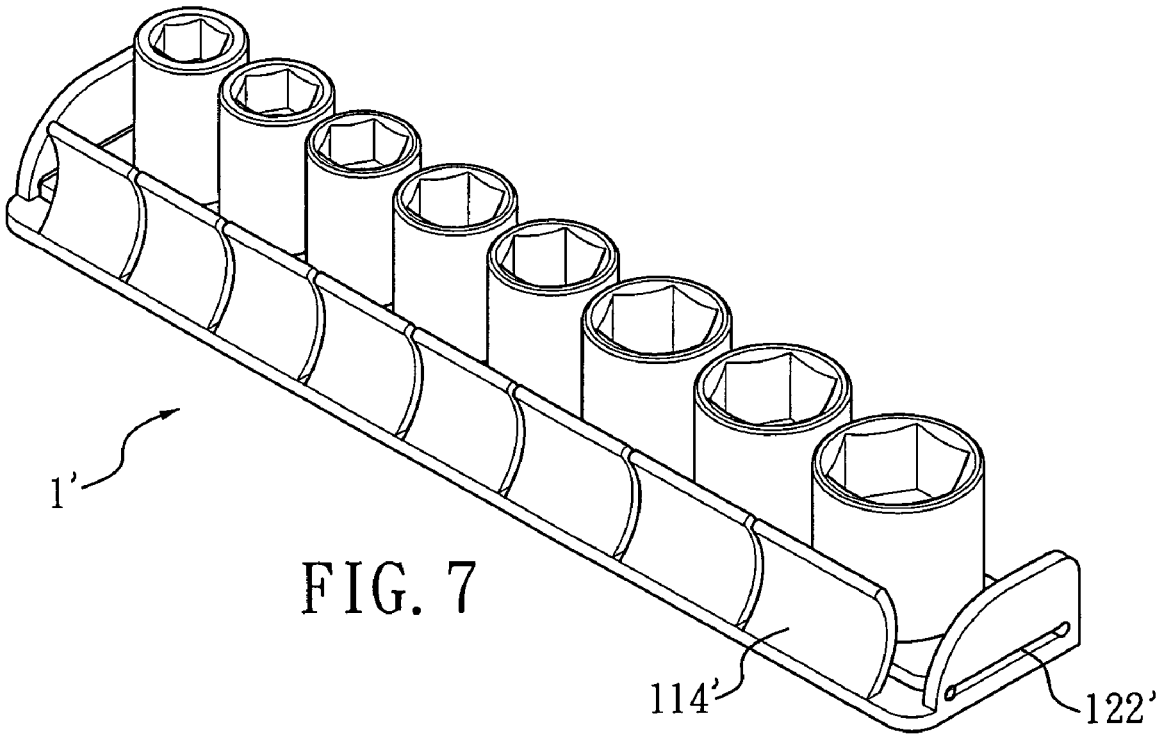
FIG. 7 illustrates a schematic view of an alternative embodiment according to the present invention.
Figure 8:
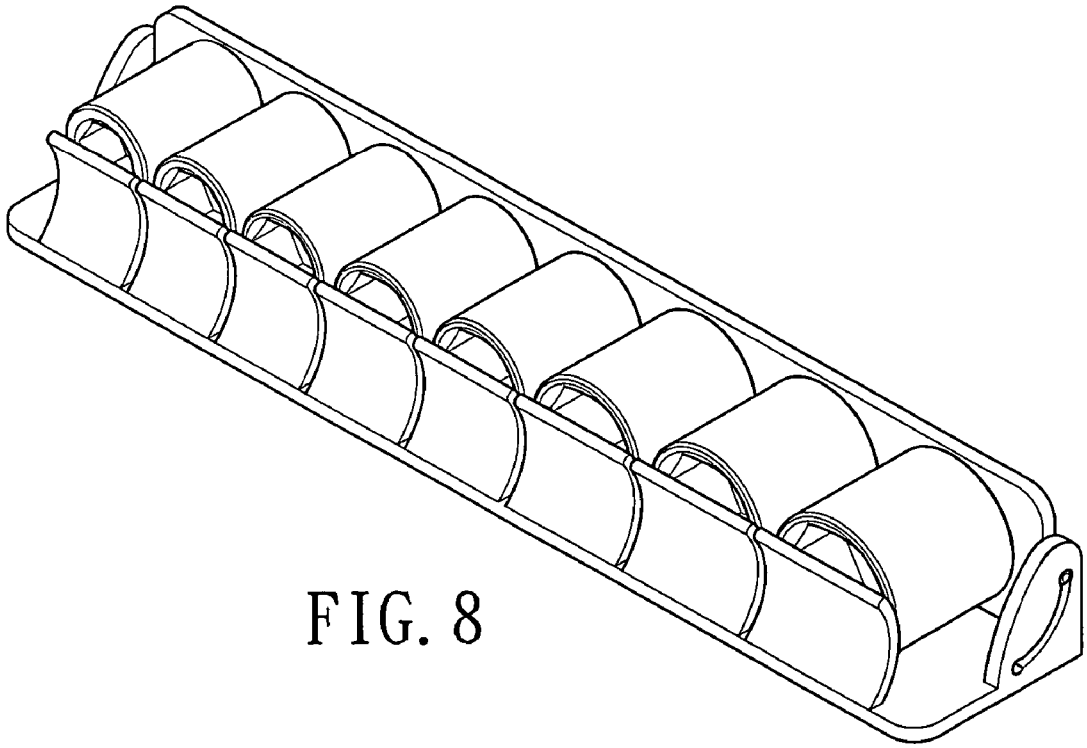
FIG. 8 illustrates a schematic view of the other embodiment showing a different configuration of the stoppers of FIG. 4.
Figure 9:
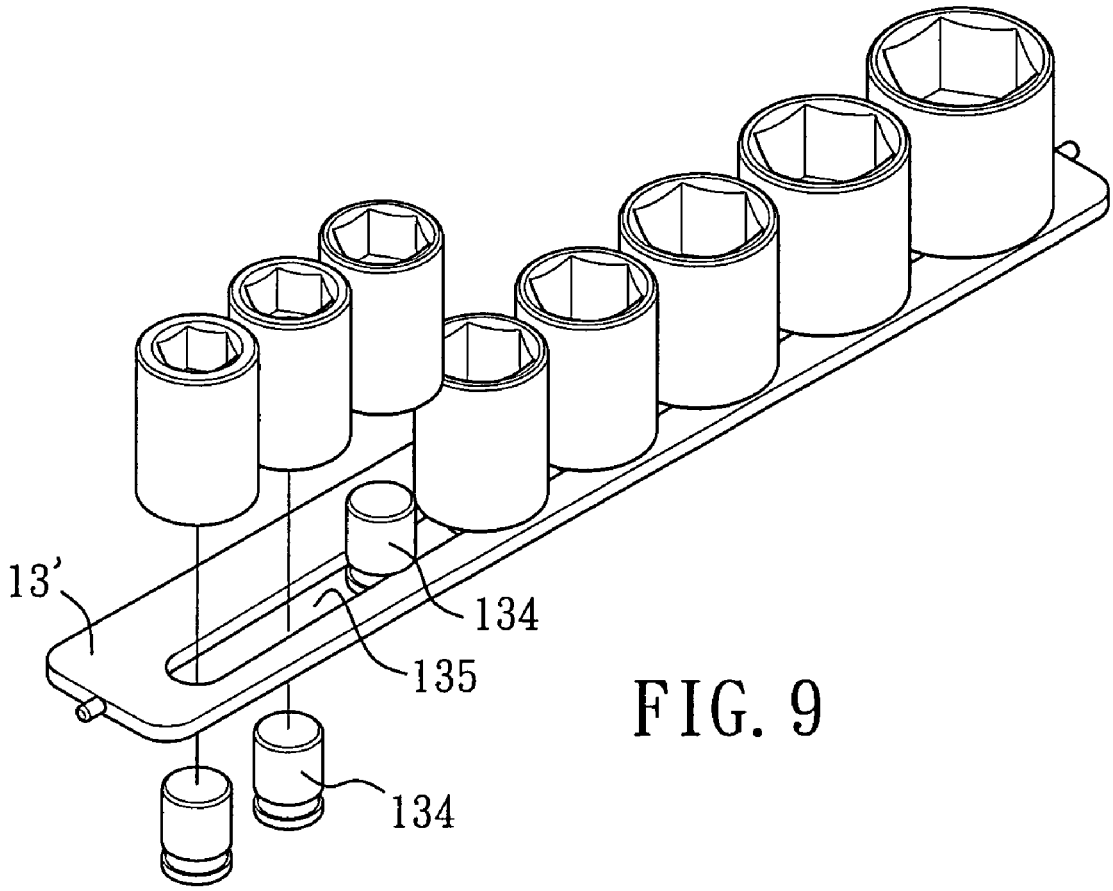
FIG. 9 illustrates a schematic view showing adjustable supports.
Figure 10:
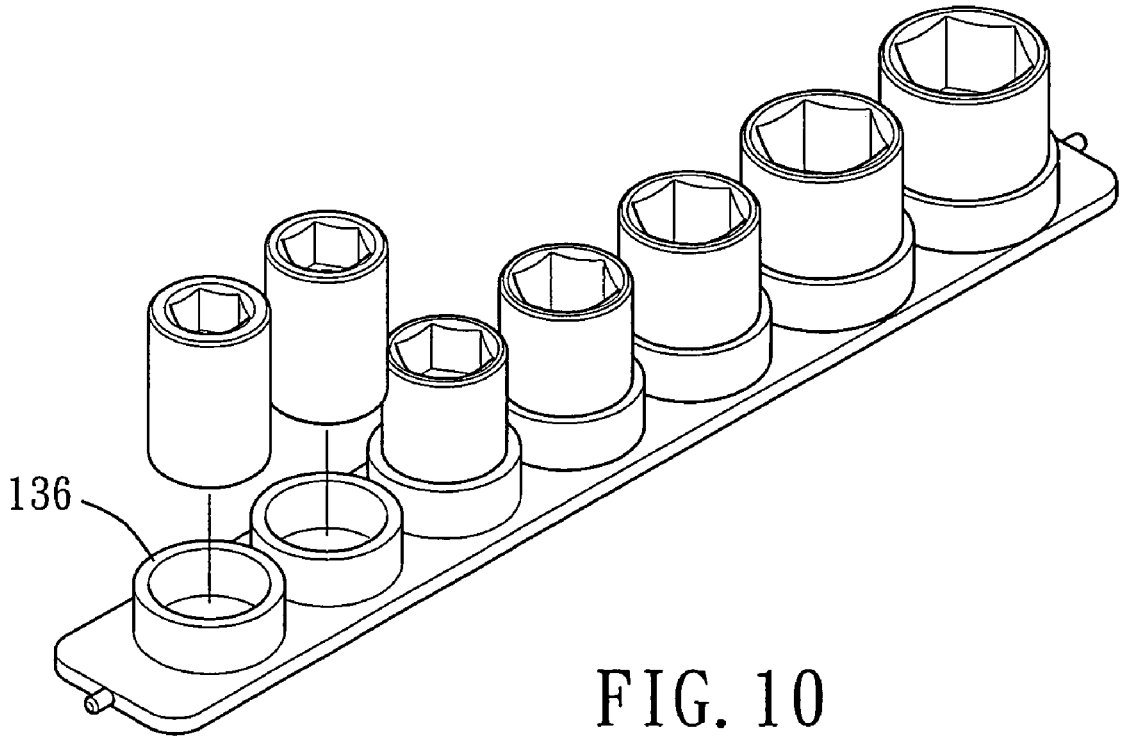
FIG. 10 illustrates a schematic view showing supports of a convex type.
Figure 11:
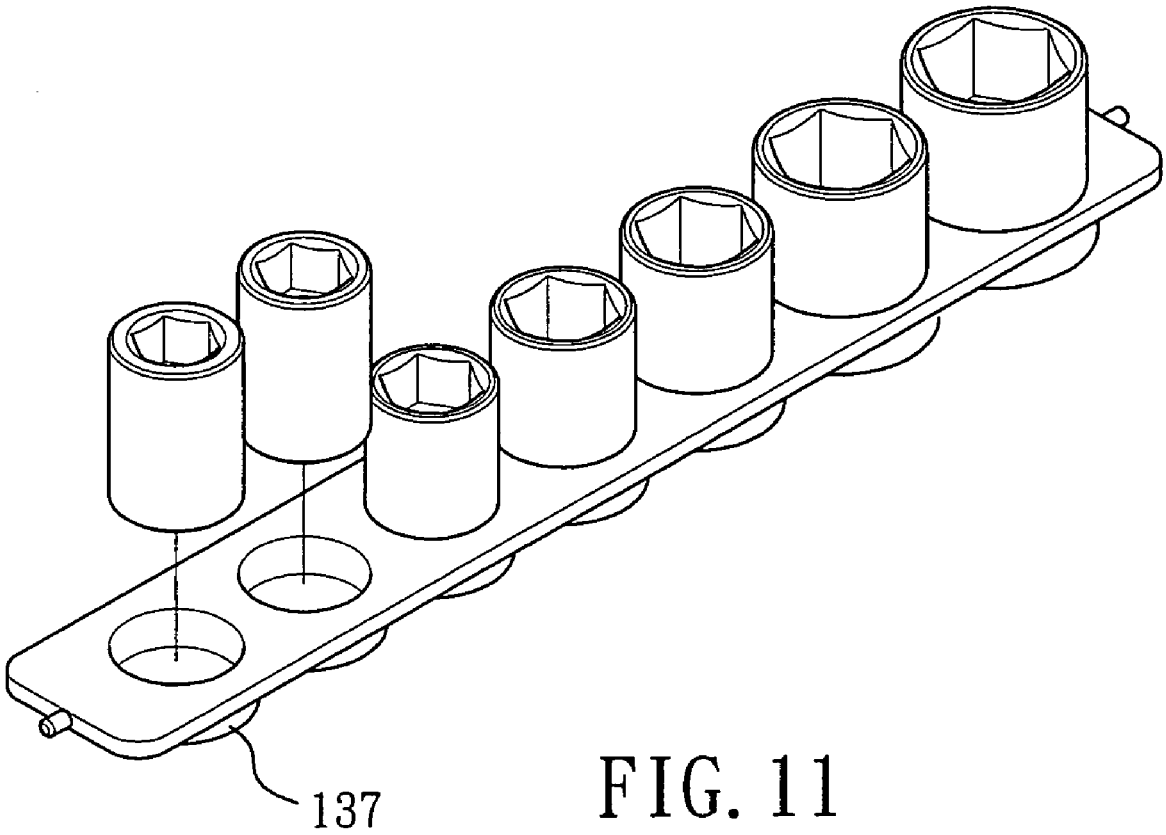
FIG. 11 illustrates a schematic view showing supports of a concave type.
Figure 12:
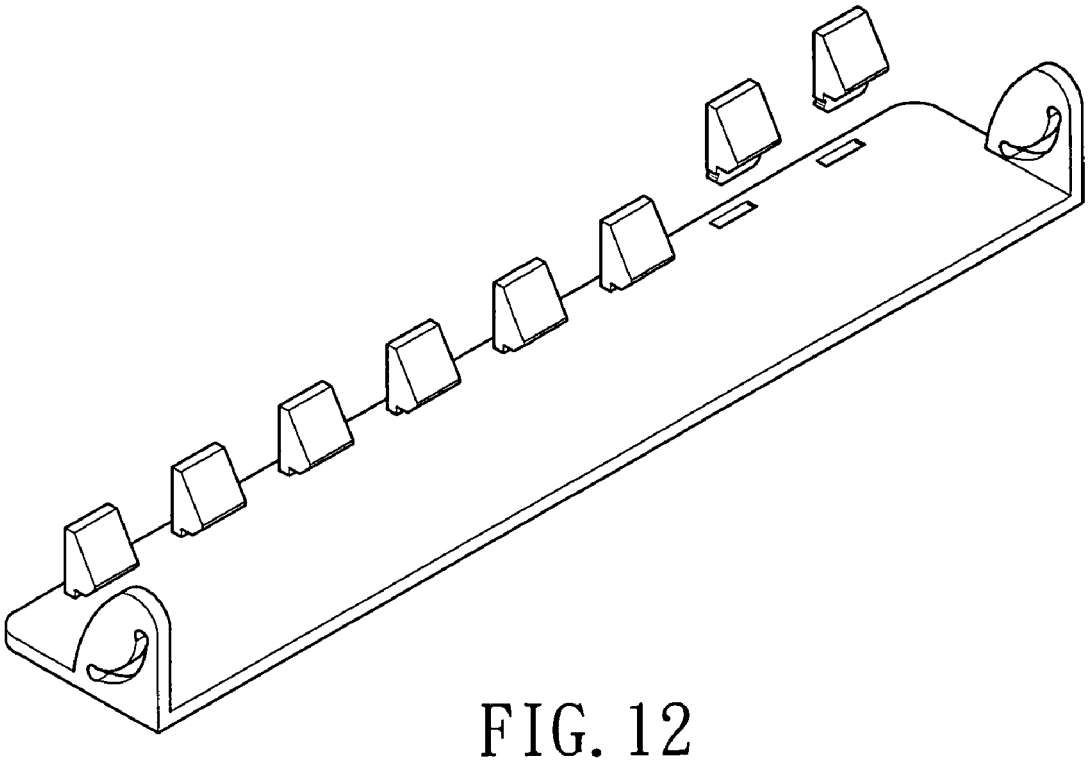
FIG. 12 illustrates a schematic view showing insertable stoppers.
Figure 13:
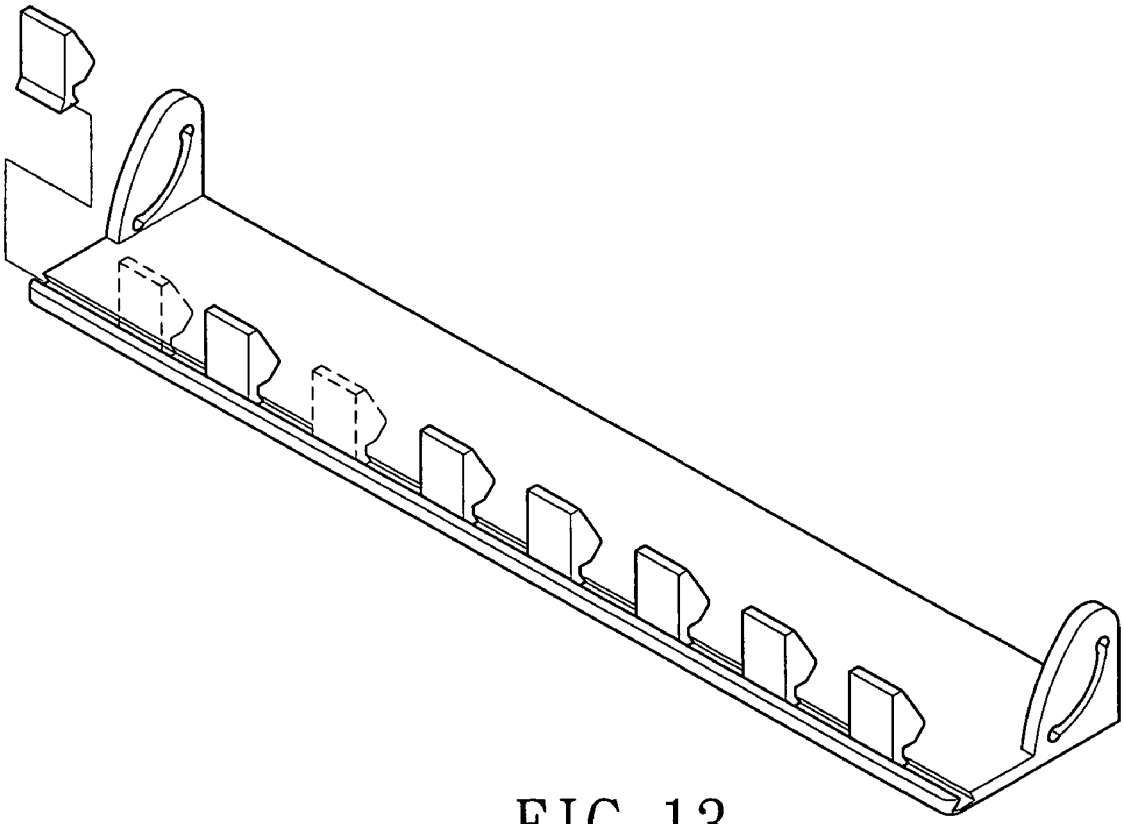
FIG. 13 illustrates a schematic view showing slidable stoppers.

As mentioned above, the support plate 13 is for supporting tool assembly parts such as sleeves 14. The sleeves can be a set with continuous or different sizes. The support plate 13 can also comprise a plurality of supports 133 and each supports the corresponding sleeve 14. Each of the sleeves 14 can be tightly fitted to the corresponding support 133, or can be loosely fitted to the corresponding support 133. Preferably, when the sleeves 14 are loosely fitted to the corresponding supports 133, a stopping device 114 is further disposed at the front end 111 of the base 11 such that when the front end 131 of the support plate 13 is moved and rotated to the second position at the rear end 112 of the base 11, because the sleeves 14 contact the stopping device 114 and press the stopping device 114 which generates an elastic force against the sleeves 14, the stopping device 114 is then adapted to prevent the sleeves 14 from separating or sliding from the supports 133 (referring to FIGS. 4 and 6A), which in turn, secures the sleeves 14 to the base 11. Similarly, when the front end 131 of the support plate 13 is moved and rotated to the first position at the front end 111 of the base 11 from the second position, because the sleeves 14 gradually disengage the stopping device 114 which releases the elastic force, the sleeves 14 can return to a free state from a secured state (referring to FIGS. 5 and 6B). The stopping device can be of any suitable design. As shown in FIG. 7, the stopping device can comprise a plurality of stoppers 114' and each substantially corresponds to the respective support (not shown in figure). The stoppers can also be removably mounted at the front end of the base (referring to FIG. 12), or slidably mounted at the front end of the base (referring to FIG. 13). The supports 133 as shown in FIG. 3 can also be modified to adjustable supports 134 shown in FIG. 9, which can move along a slot 135 disposed in a support plate 13' to suit sleeves of different sizes or quantity. In addition, supports 136 of a convex type shown in FIG. 10 or supports 137 of a concave type can also be employed without departing from the spirit of the present invention.

Figure 14:
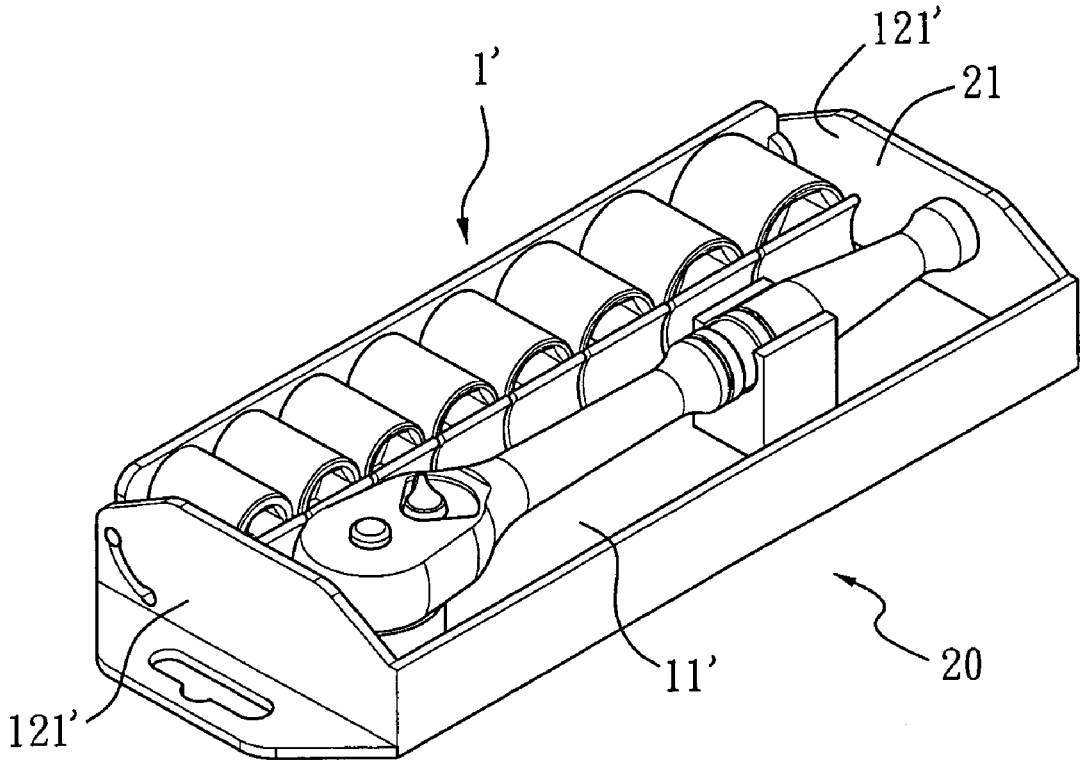
FIG. 14 illustrates a one-piece tool display unit package showing the tool display unit according to the present invention integrated with the other tool assembly.
Figure 15:
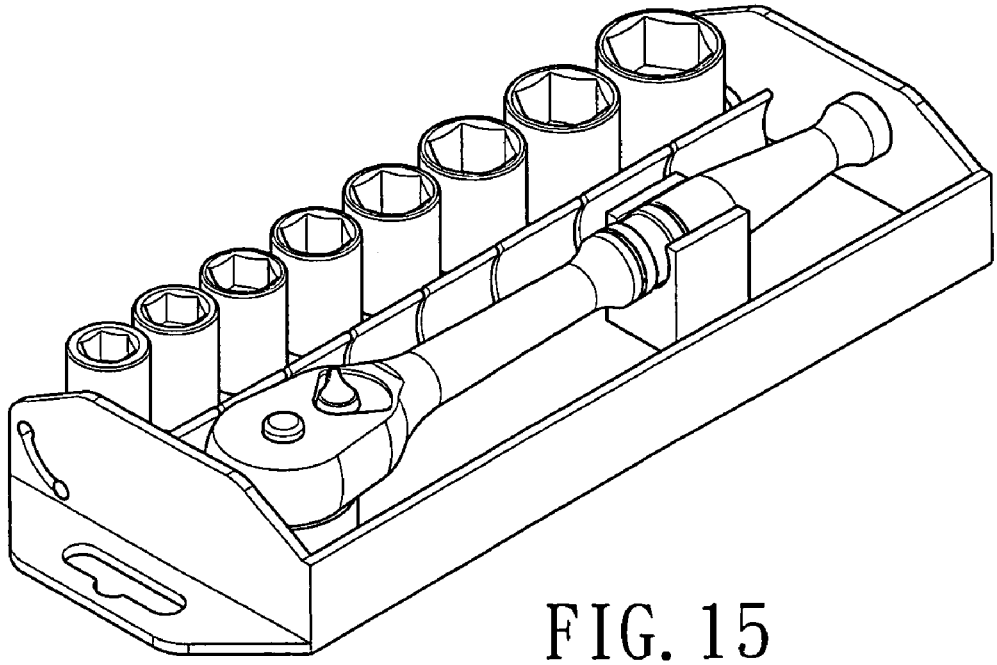
FIG. 15 illustrates a schematic view of FIG. 14 showing the sleeves rotated upwards to a retrievable position and ready for retrieval.

From the above descriptions, it is apparent that the present invention provides a display unit which has a simple configuration and stability and is easy to manufacture and use. Not only can it be used alone, but it can also be employed in conjunction with other tool display units. As shown in FIGS. 14 and 15, a tool display 20 can comprise a housing 21 having a bottom end 11' and two opposite sides defining two displaying spaces. A display unit 1' can be received in one of the displaying spaces, while the other displaying space can be used to receive tools such as wrenches, which in turn, forms an integral and complete tool package to enhance the value of the product and catch consumers' eyes. Preferably, the bottom end 11' of the housing 21 is an extension of the base of the display unit 1' and each of the two opposite sides of the tool display 1' is an extension of the corresponding wing 121'. It is possible that the two displaying spaces can also be individually defined spaces where the bottom end and the opposite sites of each are coupled to each other.

While the invention has been described in terms of several preferred embodiments, those skilled in the art will recognise that the invention can still be practiced with modifications, within the spirit and scope of the appended claims.

What is claimed is:

1. A display unit for storing a tool assembly, comprising:

a base having a front end, a rear end opposite the front end and two opposite sides;

a support plate having a front end and two opposite sides for supporting the tool assembly; and a moving-rotating mechanism comprising two opposite moving-rotating devices, each of the moving-rotating devices comprising:

a wing disposed perpendicularly at one of the two opposite sides of the base;

a guiding slot formed in the wing; and a protrusion disposed transversely at one of the two opposite sides of the support plate;

wherein the front end of the support plate is movable and rotatable from a first position at the front end of the base to a second position at the rear end of the base; when each of the two opposite sides of the base is coupled to a corresponding one of the two opposite sides of the support plate by the respective moving-rotating device, the protrusion is movable and rotatable along the guiding slot of the wing; and the guiding slot comprises a front section and a rear section, each having a narrowing neck formed thereof such that the protrusion is provided with a proper friction force when the protrusion passes through the neck.

2. The display unit according to claim 1, wherein the guiding slot is an arc curvedly extending upwards and backwards.

3. The display unit according to claim 1, wherein the guiding slot is of a straight line shape extending backwards.

4. The display unit according to claim 1, wherein the tool assembly comprises a set of sleeves of different sizes.

5. The display unit according to claim 4, wherein the support plate has a plurality of supports, each supporting the corresponding sleeve.

6. The display unit according to claim 5, wherein the support plate is formed with a slot such that the supports are slidably mounted to the slot.

7. The display unit according to claim 5, wherein each of the sleeves is tightly fitted to the corresponding support.

8. The display unit according to claim 5, wherein each of the sleeves is loosely fitted to the corresponding support.

9. The display unit according to claim 8, further comprising a stopping device disposed at the front end of the base such that when the front end of the support plate is moved and rotated to the second position at the rear end of the base, the stopping device can prevent the sleeves from separating from the supports.

10. The display unit according to claim 9, wherein the stopping device has a plurality of stoppers, each substantially corresponding to the respective support.

11. The display unit according to claim 10, wherein the stoppers are removable.

12. The display unit according to claim 11, wherein the stoppers are slidable.

13. A tool display, comprising:

a housing having a bottom end and two opposite sides defining a plurality of displaying spaces; and a display unit according to claim 4, received in one of the displaying spaces.

14. The tool display according to claim 13, wherein the bottom end of the housing is an extension of the base of the display unit and each of the two opposite sides of the tool display is an extension of the corresponding wing.

* * * * *